US008886100B2

(12) United States Patent
Suzuki et al.

(10) Patent No.: US 8,886,100 B2
(45) Date of Patent: Nov. 11, 2014

(54) FUSER UNIT

(71) Applicants: Noboru Suzuki, Komaki (JP); Kei Ishida, Nagoya (JP); Takuji Matsuno, Ichinomiya (JP); Kaoru Suzuki, Ichinomiya (JP)

(72) Inventors: Noboru Suzuki, Komaki (JP); Kei Ishida, Nagoya (JP); Takuji Matsuno, Ichinomiya (JP); Kaoru Suzuki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 122 days.

(21) Appl. No.: 13/625,174

(22) Filed: Sep. 24, 2012

(65) Prior Publication Data

US 2013/0136513 A1 May 30, 2013

(30) Foreign Application Priority Data

Nov. 29, 2011 (JP) ..... 2011-260478
Nov. 29, 2011 (JP) ..... 2011-260483

(51) Int. Cl.
*G03G 15/01* (2006.01)

(52) U.S. Cl.
USPC ..... 399/329

(58) Field of Classification Search
CPC ..... G03G 2215/2035; G03G 2215/2016; G03G 15/2067
USPC ..... 399/329
See application file for complete search history.

(56) References Cited

U.S. PATENT DOCUMENTS

2011/0158718 A1 6/2011 Fujiwara et al.
2011/0164906 A1* 7/2011 Ishida et al. ..... 399/329

FOREIGN PATENT DOCUMENTS

JP 2011-095534 A 5/2011

* cited by examiner

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

A fuser unit, which heat-fixes a developer image transferred on a recording sheet while moving the recording sheet in a predetermined direction, the fuser unit comprising: a cylindrical member having flexibility; a heat generation member that is arranged at an inside of the cylindrical member and generates radiation heat; a nip member that slidingly contacts an inner periphery of the cylindrical member; a reflection plate that contacts the nip member, is configured to cover the heat generation member and reflects the radiation heat toward the nip member, and a backup member that forms a nip region by nipping the cylindrical member between the nip member and the backup member, wherein the nip member and the reflection plate intermittently contact each other in an axial direction of the cylindrical member within an image forming width.

17 Claims, 11 Drawing Sheets

FUSER UNIT

CROSS-REFERENCE TO RELATED APPLICATION

This application claims priority from Japanese Patent Applications No. 2011-260478 filed on Nov. 29, 2011 and 2011-260483 filed on Nov. 29, 2011 the entire subject matter of which is incorporated herein by reference.

TECHNICAL FIELD

This disclosure relates to a fuser unit that heat-fixes a developer image transferred on a recording sheet.

BACKGROUND

Currently, a fuser unit is used in an image forming apparatus of an electrophotographic type and includes a cylindrical fixing belt, a heater disposed at an inside of the fixing belt and generating radiation heat, a nip member slidingly contacting an inner periphery of the fixing belt and a reflection plate configured to cover the heater and reflecting the radiation heat toward the nip member (for example, refer to JP-A-2011-95534).

Specifically, the reflection plate continuously contacts the nip member over a substantial entire width in a longitudinal direction thereof.

However, according to the above art, the heat of the nip member escapes to the reflection plate, so that it is difficult to efficiently heat the nip member.

Accordingly, this disclosure provides at least a fuser unit capable of improving heating efficiency of a nip member.

With taking into consideration the above, a fuser unit of a first aspect of disclosure, which heat-fixes a developer image transferred on a recording sheet while moving the recording sheet in a predetermined direction, the fuser unit comprises: a cylindrical member having flexibility; a heat generation member that is arranged at an inside of the cylindrical member and generates radiation heat; a nip member that slidingly contacts an inner periphery of the cylindrical member; a reflection plate that contacts the nip member, is configured to cover the heat generation member and reflects the radiation heat toward the nip member, and a backup member that forms a nip region by nipping the cylindrical member between the nip member and the backup member. In the above fuser unit, the nip member and the reflection plate intermittently contact each other in an axial direction of the cylindrical member within an image forming width.

Further, another fuser unit of a first aspect of disclosure, which heat-fixes a developer image transferred on a recording sheet while moving the recording sheet in a predetermined direction, the fuser unit comprises: a cylindrical member having flexibility; a heat generation member that is arranged at an inside of the cylindrical member and generates radiation heat; a nip member that slidingly contacts an inner periphery of the cylindrical member; a reflection plate that contacts the nip member, is configured to cover the heat generation member and reflects the radiation heat toward the nip member; and a backup member that forms a nip region by nipping the cylindrical member between the nip member and the backup member. In the above another fuser unit, at least one of the nip member and the reflection plate has a contact part that contacts the other of the nip member and the reflection plate over an image forming width, and at least a portion of the contact part is cut out within the image forming width.

Accordingly, since the nip member and the reflection plate intermittently contact each other in the axial direction of the cylindrical member within the image forming width and then the escape of the heat from the nip member to the reflection plate is reduced, it is possible to improve the efficiency of the reflection plate reflecting the radiation heat.

A fuser unit of a second aspect of disclosure, which heat-fixes a developer image transferred on a recording sheet while moving the recording sheet in a predetermined direction, the fuser unit comprises: a cylindrical member having flexibility; a heat generation member that is arranged at an inside of the cylindrical member and generates radiation heat; a nip member that slidingly contacts an inner periphery of the cylindrical member; a reflection plate having a substantial U shape that is opened at a side facing the nip member so as to cover the heat generation member, as viewed from an axial direction of the cylindrical member; a backup member that forms a nip region by nipping the cylindrical member between the nip member and the backup member, and a stay having a substantial U shape that is opened at a side facing the nip member so as to cover the reflection plate, as viewed from the axial direction, the stay supporting the reflection plate from an opposite side to the backup member, wherein at least one of a pair of wall parts arranged at both sides of the reflection plate in the predetermined direction is inclined so that an inner surface thereof faces the nip member.

Accordingly, since the inner surface of the reflection plate is configured to face the nip member, it is possible to improve the efficiency of the reflection plate reflecting the radiation heat.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, illustrative embodiments of this disclosure will be specifically described with reference to the drawings.

<First Illustrative Embodiment>

In the below descriptions, a schematic configuration of a laser printer 1 having a fuser unit 100 according to a first illustrative embodiment of this disclosure will be briefly described and then a specific configuration of the fuser unit 100 will be described.

Additionally, in the below descriptions, the directions are described on the basis of a user who uses the laser printer 1. That is, the left side of FIG. 1 is referred to as the 'front', the right side is referred to as the 'rear', the front side is referred to as the 'right' and the back side is referred to as the 'left.' Also, the upper-lower direction of FIG. 1 is referred to as the 'upper-lower.'

<Schematic Configuration of Laser Printer>

Figure 1:
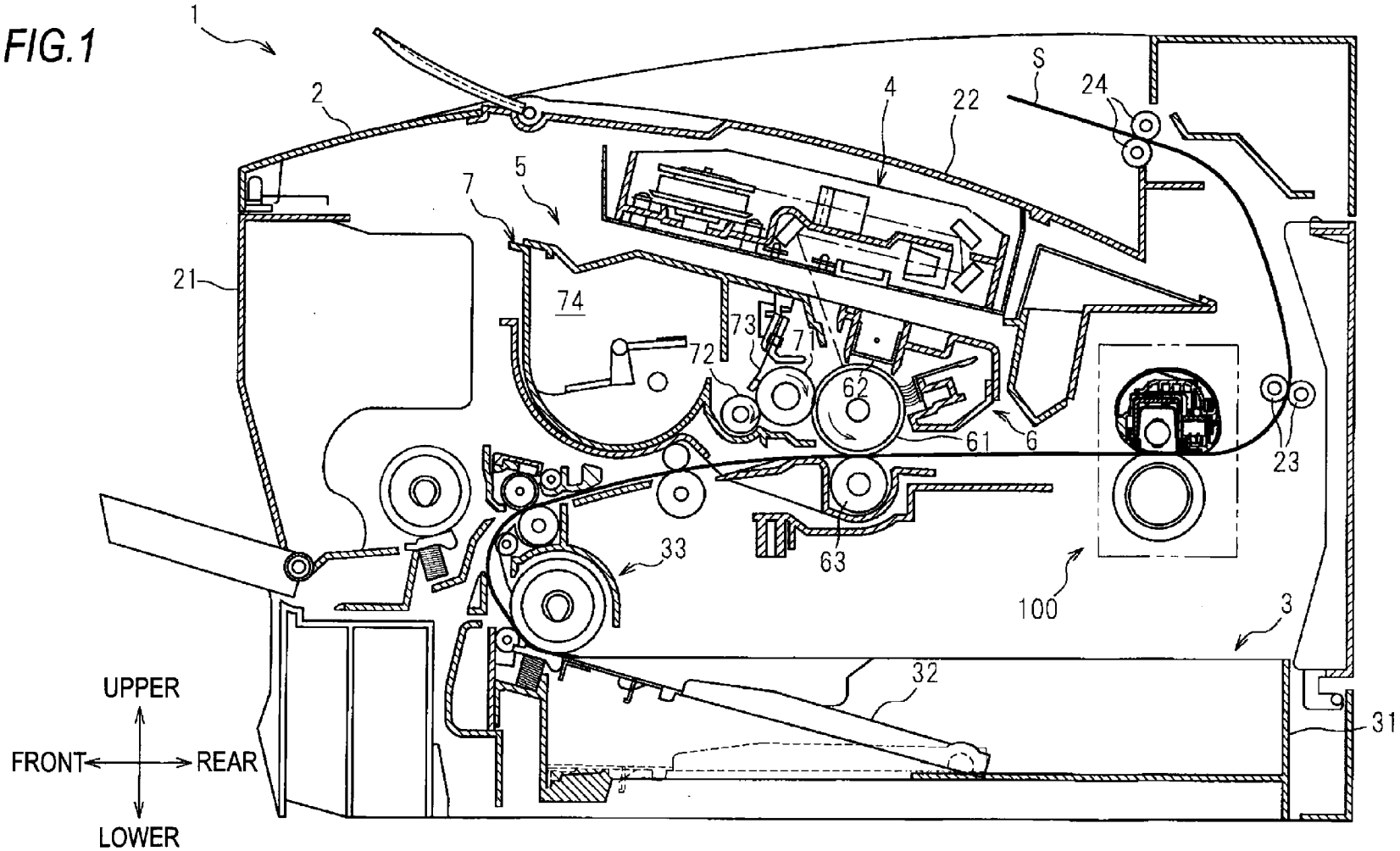
FIG. 1 illustrates a schematic configuration of a laser printer having a fuser unit according to a first aspect of this disclosure.

As shown in FIG. 1, the laser printer 1 mainly has, in a body housing 2, a feeder unit 3 that feeds a sheet S, which is an example of the recording sheet, an exposure device 4, a process cartridge 5 that transfers a toner image (developer image) on the sheet S and a fuser unit 100 that heat-fixes the toner image on the sheet S.

The feeder unit 3 is provided at a lower part in the body housing 2 and mainly has a sheet feeding tray 31, a sheet pressing plate 32 and a sheet feeding mechanism 33. The sheet S accommodated in the sheet feeding tray 31 is upwardly displaced by the sheet pressing plate 32 and is fed toward the process cartridge 5 (between a photosensitive drum 61 and a transfer roller 63) by the sheet feeding mechanism 33.

The exposure device 4 is arranged at an upper part in the body housing 2 and has a laser emitting unit (not shown), a polygon mirror, a lens, a reflector and the like whose reference numerals are omitted. In the exposure device 4, a laser light (refer to the dotted-dashed line) based on image data, which is emitted from the laser emitting unit, is scanned on a surface of the photosensitive drum 61 at high speed, thereby exposing the surface of the photosensitive drum 61.

The process cartridge 5 is disposed below the exposure device 4 and is detachably mounted to the body housing 2 through an opening that is formed when a front cover 21 provided to the body housing 2 is opened. The process cartridge 5 has a drum unit 6 and a developing unit 7.

The drum unit 6 mainly has the photosensitive drum 61, a charger 62 and the transfer roller 63. Also, the developing unit 7 is detachably mounted to the drum unit 6 and mainly has a developing roller 71, a supply roller 72, a layer thickness regulation blade 73 and a toner accommodation unit 74 that accommodates toner (developer).

In the process cartridge 5, the surface of the photosensitive drum 61 is uniformly charged by the charger 62 and then exposed by the high-speed scanning of the laser light emitted from the exposure device 4, so that an electrostatic latent image based on image data is formed on the photosensitive drum 61. Also, the toner in the toner accommodation unit 74 is supplied to the developing roller 71 via the supply roller 72, is introduced between the developing roller 71 and the layer thickness regulation blade 73 and is carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible and a toner image is thus formed on the photosensitive drum 61. Then, the sheet S is conveyed between the photosensitive drum 61 and the transfer roller 63, so that the toner image on the photosensitive drum 61 is transferred onto the sheet S.

The fuser unit 100 is arranged at the rear of the process cartridge 5. The toner image (toner) transferred on the sheet S passes through the fuser unit 100, so that the toner image is heat-fixed on the sheet S. The sheet S having the toner image heat-fixed thereon is discharged on a sheet discharge tray 22 by conveyance rollers 23, 24.

<Detailed Configuration of Fuser Unit>

Figure 2:
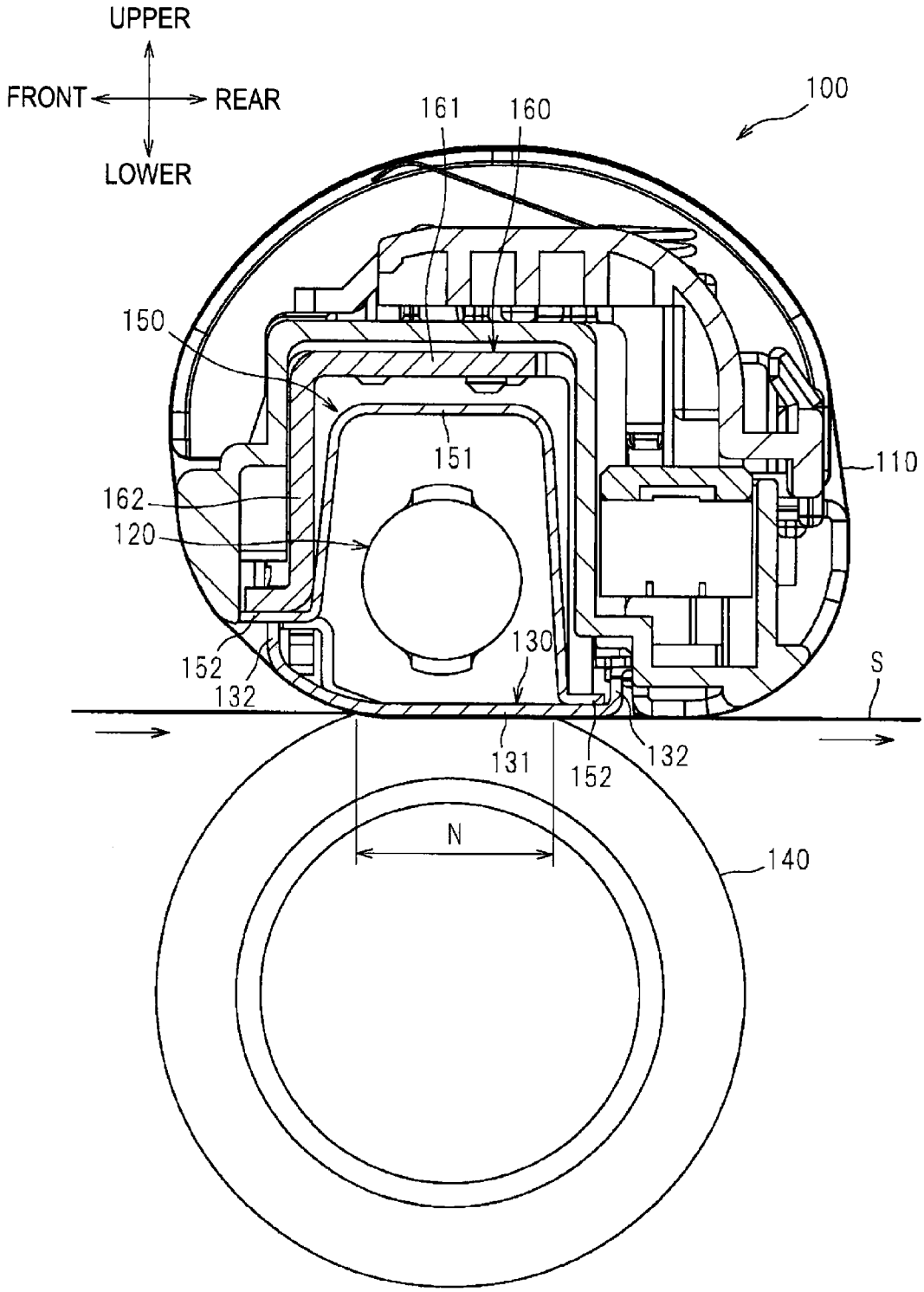
FIG. 2 is a sectional view illustrating the fuser unit.
Figure 8:
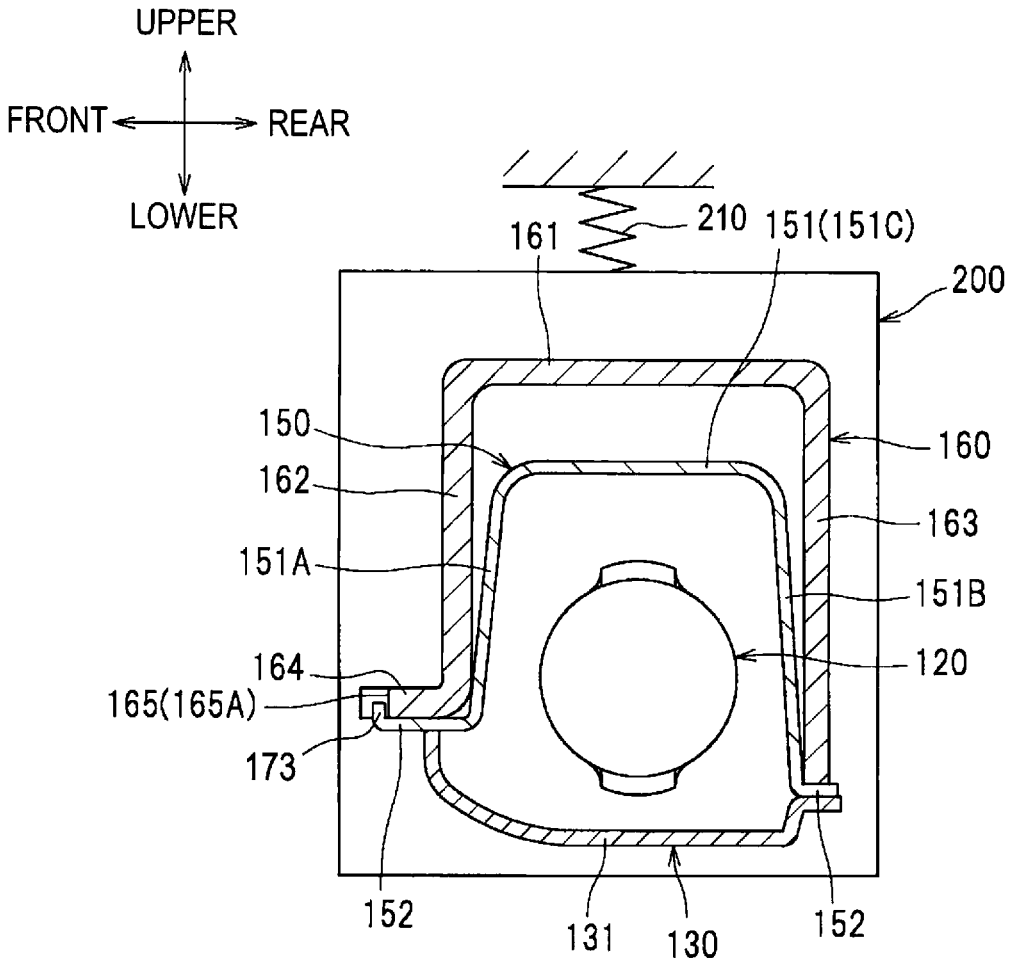
FIG. 8 is a schematic view illustrating a halogen lamp, the nip plate, the reflection plate and the stay.
Figure 9:
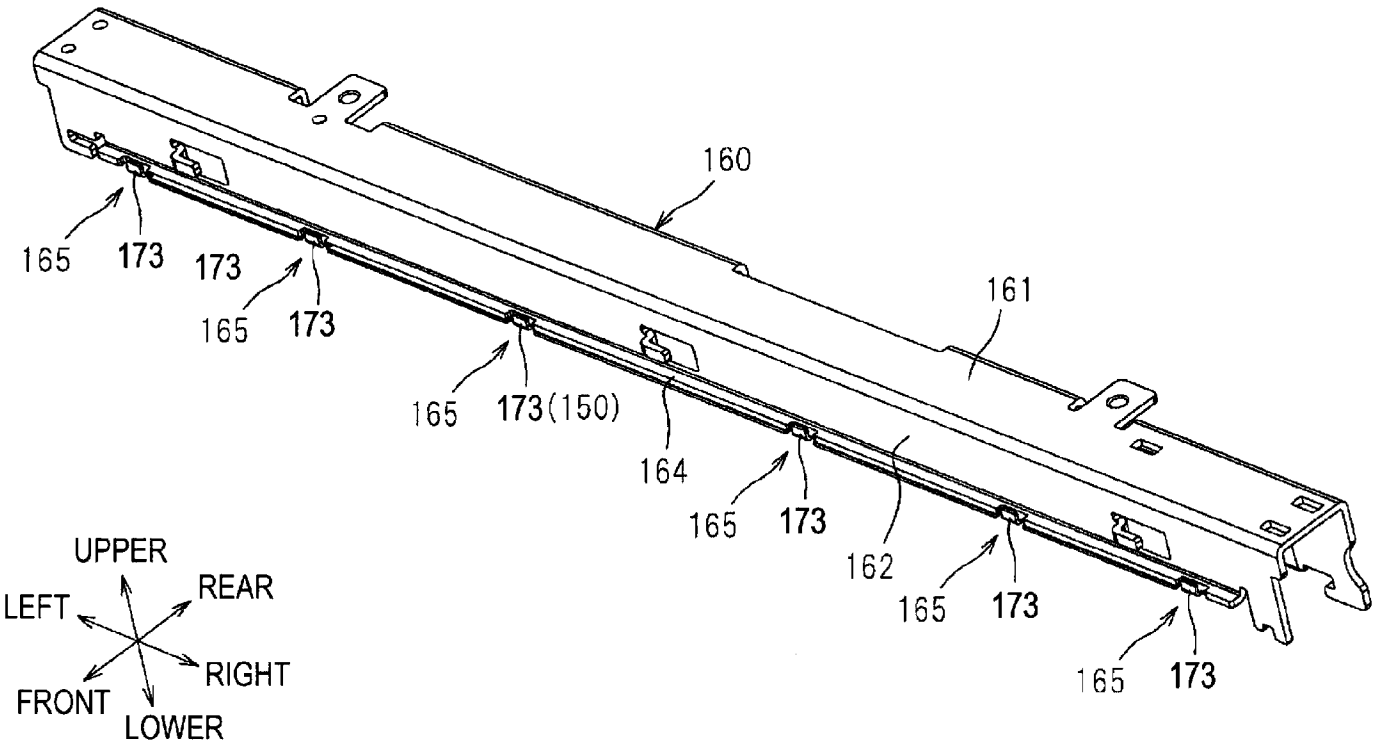
FIG. 9 is a perspective view illustrating the stay having the reflection plate mounted thereto.

As shown in FIG. 2, the fuser unit 100 mainly has a fixing belt 110 that is an example of the cylindrical member, a halogen lamp 120 that is an example of the heat generation member, a nip plate 130 that is an example of the nip member, a pressing roller 140 that is an example of the backup member, a reflection plate 150, a stay 160, and side guides 200, which is shown in FIG. 8.

The fixing belt 110 is a belt of an endless shape (cylindrical shape) having heat resistance and flexibility and rotation thereof is guided by a guide member whose reference numeral is omitted.

The halogen lamp 120 is a heater that generates radiation heat to thus heat the nip plate 130 and the fixing belt 110, thereby heating the toner on the sheet S. The halogen lamp is arranged at the inside of the fixing belt 110 at a predetermined interval from inner surfaces of the fixing belt 110 and the nip plate 130.

The nip plate 130 is a plate-shaped member to which the radiation heat from the halogen lamp 120 is applied, and is arranged at the inside of the fixing belt 110 so that a lower surface thereof slidingly contacts an inner periphery of the cylindrical fixing belt 110. In this illustrative embodiment, the nip plate 130 is formed by bending an aluminum plate and the like having thermal conductivity higher than the stay 160 made of steel, which will be described later.

Figure 3:
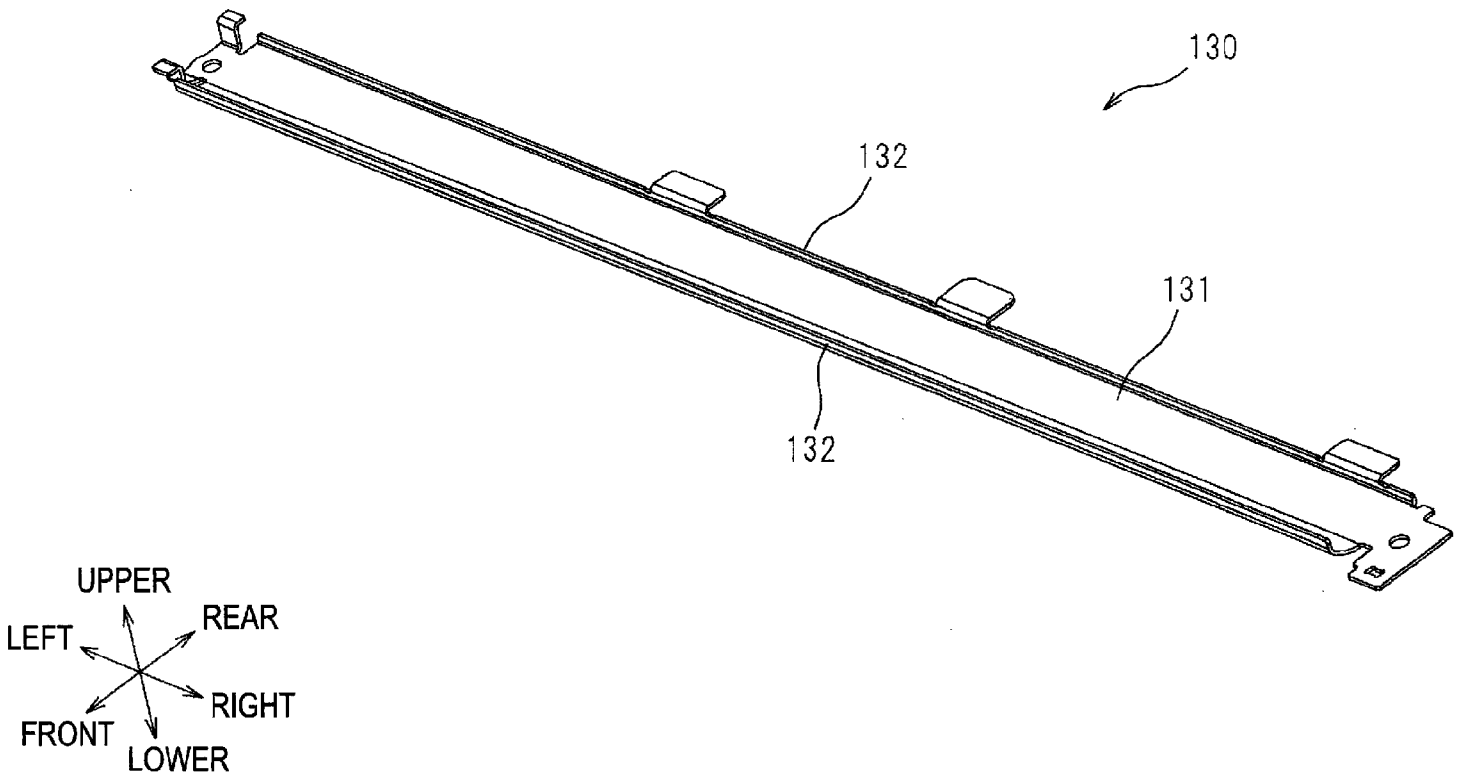
FIG. 3 is a perspective view illustrating a nip plate.

As shown in FIG. 3, the nip plate 130 has a base part 131 and bent parts 132.

The base part 131 is a part that slidingly contacts the inner periphery of the fixing belt 110 at a lower surface thereof and is configured to transfer the heat from the halogen lamp 120 to the toner on the sheet S through the fixing belt 110. The bent parts 132 are formed to extend upward from front and rear ends of the base part 131.

As shown in FIG. 2, the pressing roller 140 is an elastically deformable member and is disposed below the nip plate 130. The pressing roller 140 forms a nip region N by nipping the fixing belt 110 between the nip plate 130 and the pressing roller with being elastically deformable. In this illustrative embodiment, one of the nip plate 130 and the pressing roller 140 is urged toward the other, so that they pressure-contact each other.

The pressing roller 140 is configured to rotate as a driving force is transferred thereto from a motor (not shown) provided in the body housing 2. As the pressing roller rotates, it rotates the fixing belt 110 by a frictional force with the fixing belt 110 (or sheet S). Thereby, the sheet S having the toner image transferred thereto is conveyed between the pressing roller 140 and the heated fixing belt 110 in the front-rear direction (the predetermined direction), so that the toner image (toner) is heat-fixed.

The reflection plate 150 is a member that reflects the radiation heat from the halogen lamp 120 toward the nip plate 130 (upper surface of the nip plate 130), and is arranged at a predetermined interval from the halogen lamp 120 so that the reflection plate covers the halogen lamp 120.

Figure 4:
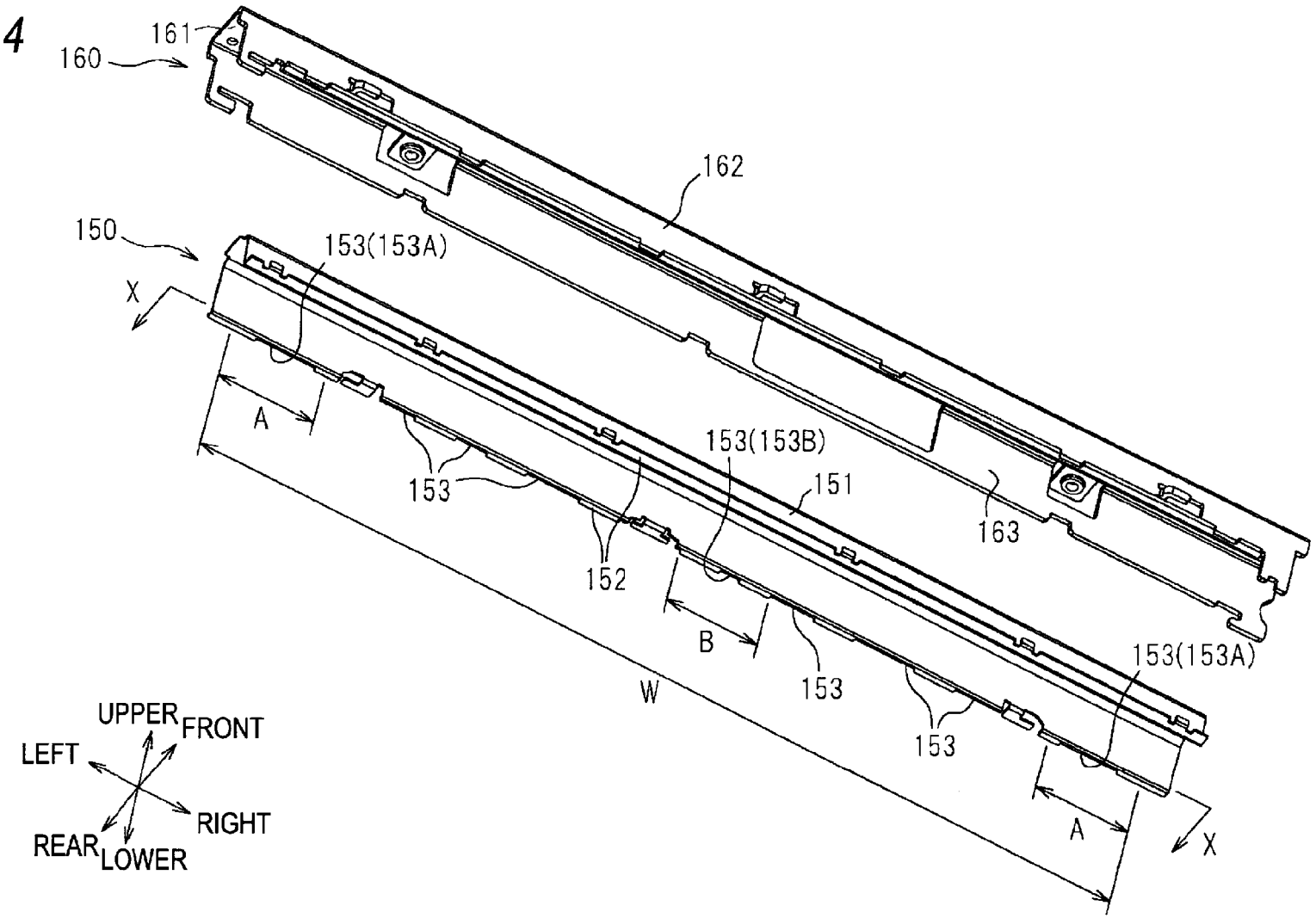
FIG. 4 is a perspective view illustrating a reflection plate and a stay.

The reflection plate 150 is formed by bending a metal plate, such as aluminum plate and the like having high reflectance of the infrared and far-infrared, into a substantial U shape, as viewed from an axial direction of the fixing belt 110 (hereinafter, simply referred to as 'axial direction'). More specifically, as shown in FIG. 4, the reflection plate 150 mainly has a reflection part 151 having a bent shape (substantial U shape as viewed from a section) and flange parts 152 extending from both lower (facing the nip plate 130) end portions of the reflection part 151 toward the outside in the front-rear direction.

The reflection part 151 is configured to gather the radiation heat, which is generated from the halogen lamp 120, to the nip plate 130. Thereby, it is possible to efficiently use the radiation heat from the halogen lamp 120 and to rapidly heat the nip plate 130 and the fixing belt 110.

The flange parts 152 are an example of the contact part contacting the nip plate 130. Specifically, the front flange part 152 contacts an upper end surface of the bent part 132 at the front side of the nip plate 130 and the rear flange part 152 contacts an upper surface of the base part 131 of the nip plate 130 (refer to FIG. 2).

Figure 5:
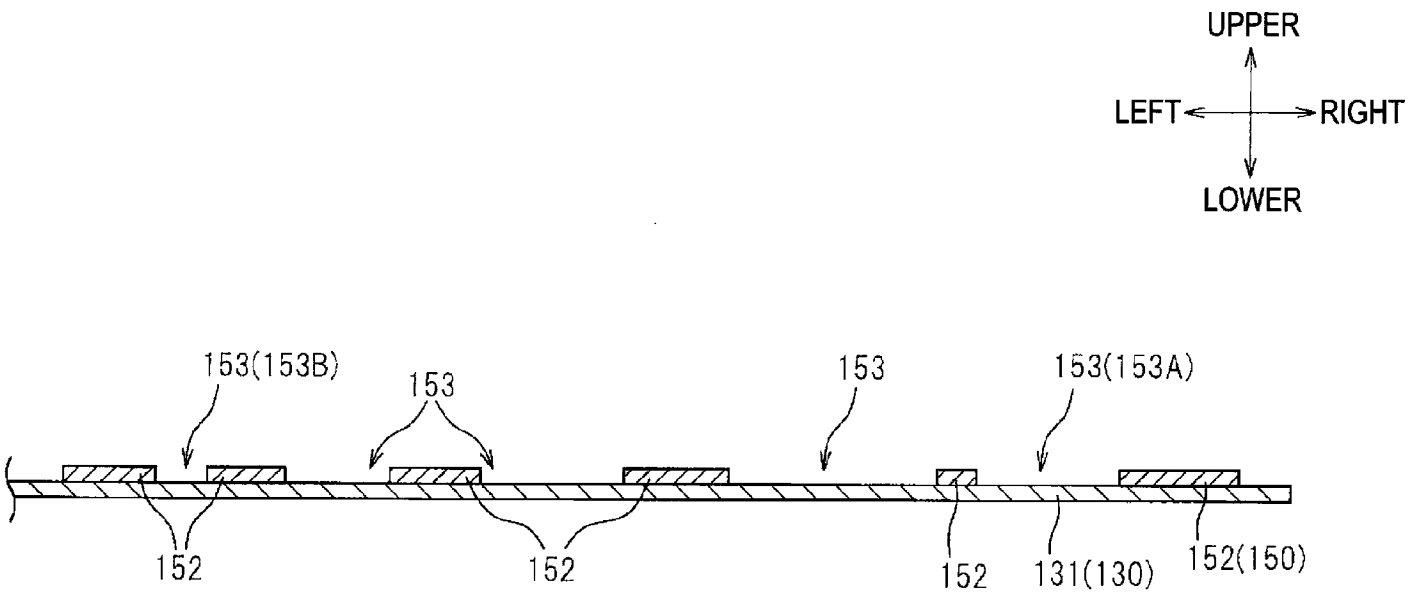
FIG. 5 is a sectional view taken along a line X-X of FIG. 4, which illustrates a contact part of the reflection plate and the nip plate.
Figure 6:
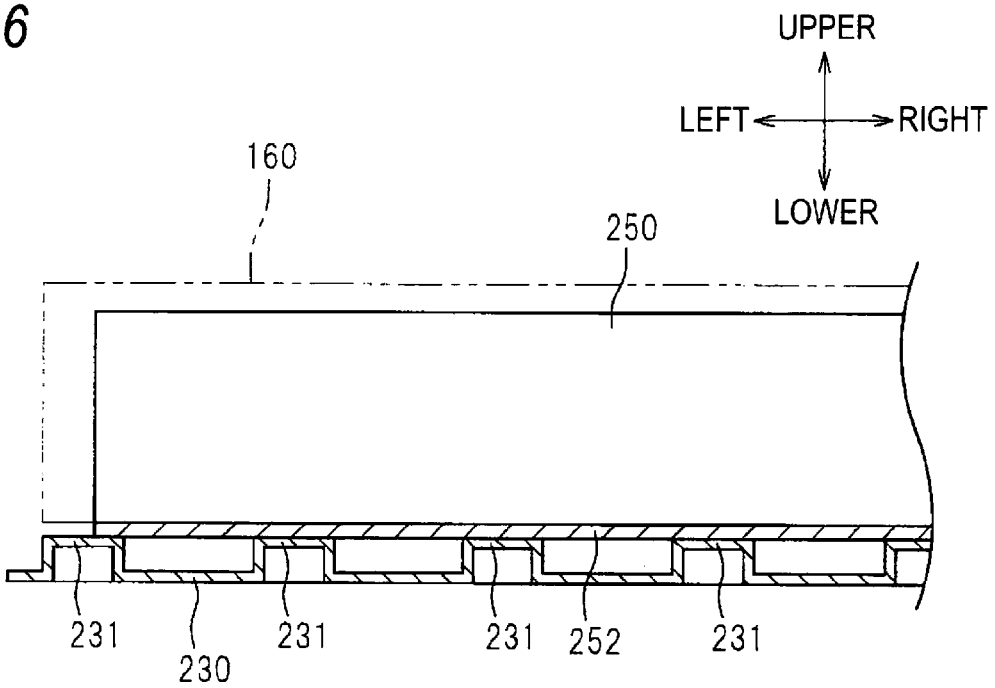
FIG. 6 is a schematic view illustrating a nip plate, a reflection plate and a stay in a fuser unit according to a modified embodiment.

The rear flange part 152 is formed with a plurality of cutout portions 153 in the axial direction within an image forming width W. Thereby, as shown in FIG. 5, the nip plate 130 and the rear flange part 152 of the reflection plate 150 intermittently contact each other in the axial direction within the image forming width W.

Specifically describing the plurality of cutout portions 153, the cutout portion 153 is formed by cutting the flange part 152 from a rear end thereof to a central portion (which is a more rear portion than a folded portion between the reflection part 151 and the flange part 152). Like this, the cutout portion 153 is formed so that it does not extend to the folded portion or reflection part 151. Thereby, it is difficult for the radiation heat to leak through the cutout portion 153.

Also, the flange part 152 is provided with the plurality of cutout portions 153 so that a sum of axial lengths of the cutout portions 153 is more than half of an entire axial length of the reflection plate 150 (refer to FIG. 4).

Also, a cutout portion 153A of the cutout portions 153, which is provided at the outermost side in the axial direction, has an axial length that is larger than that of a cutout portion 153B, which is arranged at a substantially central portion in the axial direction.

Specifically, as shown in FIG. 4, the cutout portion 153A, which is provided within a predetermined range A from both end portions of the rear flange part 152 in the axial direction, is larger than the cutout portion 153B that is provided within a predetermined range B (the axial lengths of the predetermined ranges A and B are the same) of the substantially central portion in the axial direction. Thereby, a contact area of the flange part 152 and the nip plate 130 in the predetermined range A is smaller than a contact area of the flange part 152 and the nip plate 130 in the predetermined range B.

As shown in FIG. 2, the stay 160 is a member that supports the front and rear end portions of the nip plate 130 from an opposite side to the pressing roller 140, and is arranged to cover the halogen lamp 120 and the reflection plate 150 at the inside of the fixing belt 110. The stay 160 is formed by bending a metal plate such as steel plate having relatively high rigidity into a shape (substantial U shape, as viewed from the axial direction) having an opening at a side facing the nip plate 130 and conforming to the reflection plate 150 (reflection part 151).

More specifically, as shown in FIG. 4, the stay 160 has an upper wall 161 and a front wall 162 and a rear wall 163 extending downward from front and rear ends of the upper wall part 161. A lower end portion of the front wall 162 supports the front end portion of the nip plate 130 via the front flange part 152 of the reflection plate 150 from the above and a lower end portion of the rear wall 163 supports the rear end of the nip plate 130 via the rear flange part 152 of the reflection plate 150 from the above. That is, the reflection plate 150 is sandwiched between the stay 160 and the nip plate 130, and the stay 160 is configured to hold both the reflection plate 150 and the nip plate 130.

When force is applied to the nip plate 130 from the below (the pressing roller 140-side), the stay 160 bears the force and supports the nip plate 130.

According to the above first illustrative embodiment, following effects can be obtained.

Since the nip plate 130 and the reflection plate 150 intermittently contact each other in the axial direction within the image forming width W, it is possible to reduce the escape of the heat from the nip plate 130 to the reflection plate 150 within the image forming width W. Thereby, it is possible to effectively heat the nip plate 130. Also, since the nip plate 130 and the reflection plate 150 contact each other, although the contact is intermittent, it is possible to suppress the radiation heat from leaking from between the nip plate 130 and the reflection plate 150.

The front flange part 152 of the reflection plate 150 is formed with the cutout portions 153, so that the nip plate 130 and the reflection plate 150 intermittently contact each other. Hence, it is possible to secure the rigidity of the nip plate 130, compared to a configuration where the nip plate 130 is provided with a cutout portion.

Also, since the sum of the axial lengths of the cutout portions 153 provided to the flange part 152 of the reflection plate 150 is more than half of the entire length of the flange part 152, it is possible to further reduce the contact area of the nip plate 130 and the reflection plate 150. Thereby, it is possible to further improve the heating efficiency of the nip plate 130.

The cutout portion 153A of the cutout portions 153, which is provided at the outermost side in the axial direction, has the axial length that is larger than that of the cutout portion 153B arranged at the substantially central portion in the axial direction. The contact area of the nip plate 130 and the reflection plate 150 is reduced at the axial end portion of the nip plate 130 where temperature is difficult to rise upon the start-up of the fuser unit 100. Thereby, it is possible to make a temperature distribution of the nip plate 130 uniform. Also, since the contact area of the nip plate 130 and the reflection plate 150 is large at the axially central portion that is under high temperature after using the fuser unit 100, it is possible to smoothly perform the heat radiation.

Although the first illustrative embodiment of this disclosure has been described, it should be understood that this disclosure is not limited to the first illustrative embodiment. The specific configuration can be appropriately changed without departing from the scope of this disclosure.

For example, in the above first illustrative embodiment, the flange part 152 of the reflection plate 150, which contacts the nip plate 130, is provided with the plurality of cutout portions 153, so that the nip plate 130 and the reflection plate 150 intermittently contact each other in the axial direction. However, this disclosure is not limited thereto. For example, the nip plate may be formed so that the nip plate and the reflection plate intermittently contact each other in the axial direction.

Specifically, describing the above modified embodiment, a part of a nip plate 230, which contacts a flange part 252 of a reflection plate 250, is provided with a plurality of protrusions 231 protruding toward the reflection plate 250, which are formed by deforming the nip plate 230. Thereby, the nip plate 230 and the reflection plate 250 intermittently contact each other in the axial direction.

Also, both the nip plate and the reflection plate may be provided with the cutout portions and the protrusions so that the nip plate and the reflection plate intermittently contact each other in the axial direction.

In the above first illustrative embodiment, the flange part 152 of the reflection plate 150 is provided with the plurality of cutout portions 153. However, this disclosure is not limited thereto. For example, the flange part of the reflection plate may be provided with one cutout portion.

In the above first illustrative embodiment, only the rear flange part 152 of the reflection plate 150 is provided with the cutout portions 153. However, this disclosure is not limited thereto. For example, the front flange part 152 may be also provided with a cutout portion.

In the above first illustrative embodiment, the halogen lamp 120 has been exemplified as the heat generation member. However, this disclosure is not limited thereto. For example, a carbon heater may be also used.

In the above first illustrative embodiment, the plate-shaped nip plate 130 has been exemplified as the nip member. However, this disclosure is not limited thereto. For example, a thick member other than the plate shape may be also adopted.

In the above first illustrative embodiment, the pressing roller 140 has been exemplified as the backup member. However, this disclosure is not limited thereto. For example, a belt-type pressing member may be also used.

In the above first illustrative embodiment, the sheet S such as normal sheet and postcard has been exemplified as the recording sheet. However, this disclosure is not limited thereto. For example, an OHP sheet and the like may be also used.

<Second Illustrative Embodiment>

In the below descriptions, a specific configuration of a fuser unit 100 according to a second illustrative embodiment of this disclosure will be described. A schematic configuration of a laser printer 1 having a fuser unit 100 is similarly to that of the above illustrative embodiment, and the detailed description of similar configurations will be omitted. Reference symbols in FIG. 7 are suitably replaced based on FIG. 4 to explain the second illustrative embodiment.

Figure 7:
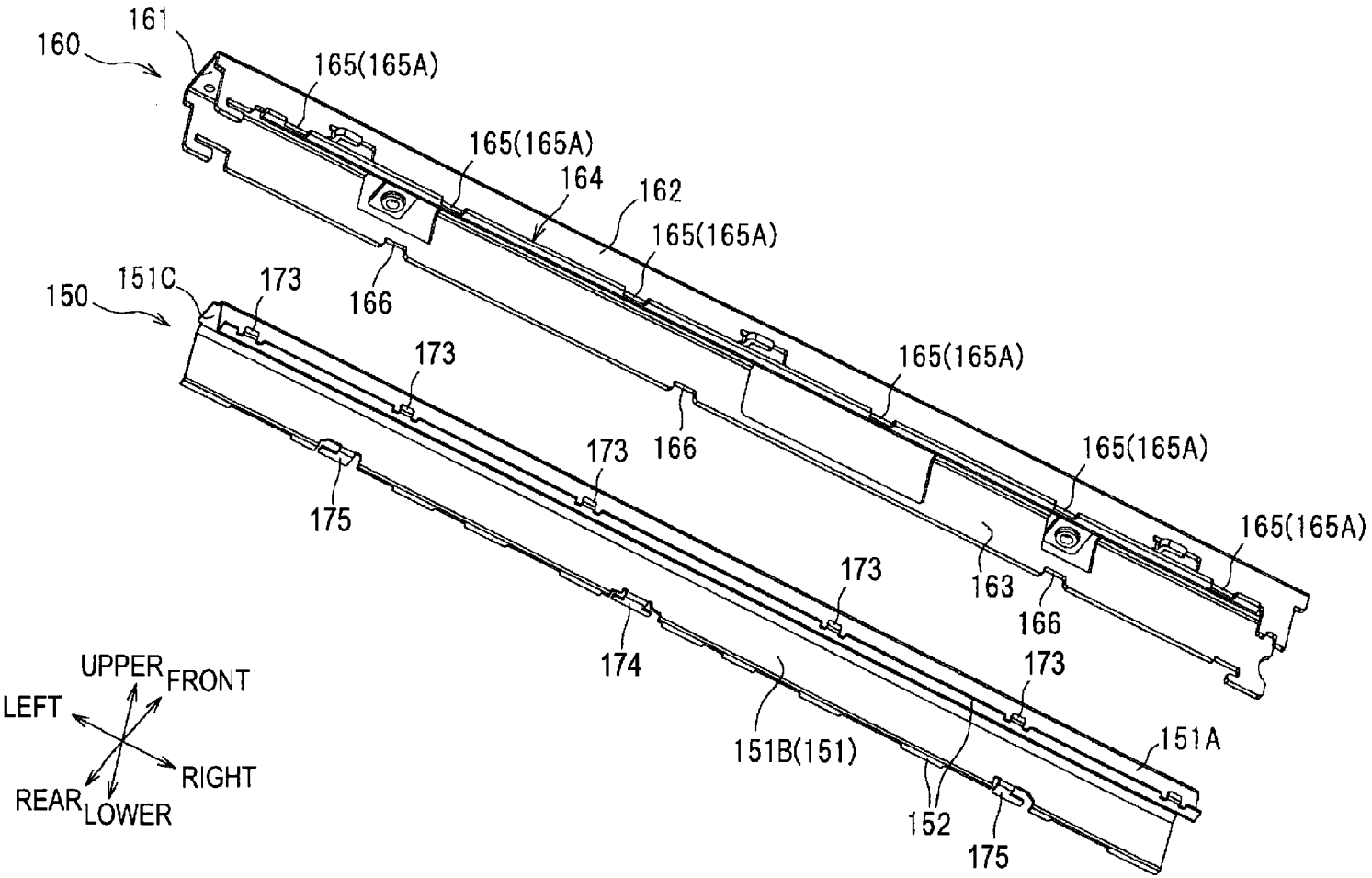
FIG. 7 is a perspective view illustrating a reflection plate and a stay according to a second aspect of this disclosure.

In the second illustrative, as shown in FIGS. 2 and 7, the reflection plate 150 mainly has a reflection part 151 having a bent shape (substantially U-shaped section), flange parts 152 extending from both end portions of the reflection part 151 facing the nip plate 130 toward the outside in the front-rear direction, first hooks 173, a second hook 174 and third hooks 175.

The reflection part 151 has side walls 151A, 151B, which are an example of the pair of wall parts interposing the halogen lamp 120 therebetween and being arranged at both sides in the front-rear direction, and an upper wall 151C connecting the pair of side walls 151A, 151B above the halogen lamp 120.

As shown in FIG. 8, the pair of side walls 151A, 151B has a shape that is inwardly inclined, and is inclined relative to the base part 131 of the nip plate 130 so that inner surfaces thereof face the nip plate 130. At a state where the pair of side walls 151A, 151B is not mounted to the stay 160, a distance from a lower end of the front side wall 151A to a lower end of the rear side wall 151B in the front-rear direction is larger than a distance between a front wall 162 and a rear wall 163 of the stay 160. Thereby, the reflection plate 150 is press-fitted and mounted to the stay 160.

The upper wall 151C of the reflection part 151 is formed to be substantially parallel with the base part 131 of the nip plate 130.

The reflection part 151 is configured as described above, so that the inner surface of the reflection part 151 (the pair of side walls 151A, 151B and the upper wall 151C) covering the halogen lamp 120 faces the nip plate 130. Therefore, the reflection plate 150 can effectively gather the radiation heat, which is generated from the halogen lamp 120, to the nip plate 130 and effectively use the radiation heat from the halogen lamp 120 to thus rapidly heat the nip plate 130 and the fixing belt 110.

Returning to FIG. 7, the plurality of first hooks 173 is an example of the engaged part, which is engaged to first engaging parts 165A of the stay 160 (which will be described later), and is provided at the front flange part 152 in the axial direction. The first hook 173 has a leading end that is extending upward.

Figure 10:
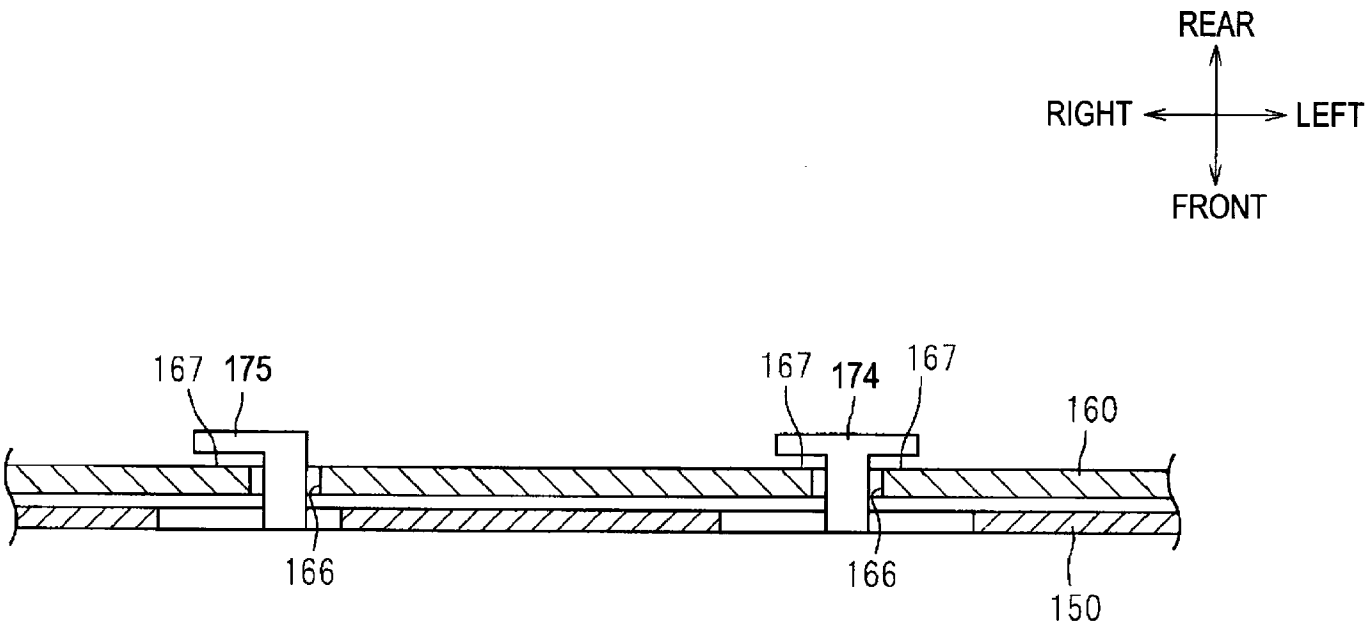
FIG. 10 is a sectional view illustrating an engagement between second and third hooks and second and third parts to be engaged.

The second and third hooks 174, 175 are examples of the engaged part, which is engaged to a second engaging part 167 of the stay 160 (refer to FIG. 10) (which will be described later), and are provided on the rear side wall 151B.

Specifically, the second hook 174 is formed above the flange parts 152 by cutting and bending rearward a lower end of a substantially central portion of the rear side wall 151B in the axial direction. The second hook 174 has a shape that extends rearward from the rear side wall 151B and then a leading end thereof extends in both left and right directions.

The third hooks 175 are formed above the flange parts 152 by cutting and bending rearward lower ends of two left and right locations of the rear side wall 151B. The third hook 175 has a shape that extends rearward from the rear side wall 151B and then a leading end thereof extends outward in the left-right direction.

As shown in FIGS. 2 and 7, the stay 160 is a member that supports both front and rear end portions of the nip plate 130 and the reflection plate 150 from an opposite side to the pressing roller 140, and is arranged to cover the halogen lamp 120 and the reflection plate 150 at the inside of the fixing belt 110. The stay 160 is formed by bending a metal plate, such as steel plate having higher rigidity than that of the reflection plate 150, into a shape (substantial U shape that is opened at a side facing the nip plate 130, as viewed from the axial direction) having an opening at a side facing the nip plate 130 and corresponding to the reflection plate 150 (reflection part 151).

More specifically, the stay 160 has an upper wall 161 and a front wall 162 and a rear wall 163 extending downward from front and rear ends of the upper wall 161. As shown in FIG. 8, the front wall 162 and the rear wall 163 are an example of the pair of side walls interposing the reflection plate 150 therebetween and being arranged at both sides in the front-rear direction, and extend perpendicularly to the nip plate 130 (base part 131), respectively.

A lower end portion of the front wall 162 is formed with a flange 164 extending outward, and the flange 164 supports the front end portion of the nip plate 130 through the front flange part 152 of the reflection plate 150 from the above. Also, a lower end portion of the rear wall 163 supports the rear end of the nip plate 130 through the rear flange part 152 of the reflection plate 150 from the above. That is, the flange parts 152 of the reflection plate 150 are sandwiched between the stay 160 and the nip plate 130. Thereby, even before the first hooks 173 are engaged to the first engaging parts 165A or the second and third hooks 174, 175 are engaged to second engaging parts 167, as described below, it is possible to suppress the deformation of the reflection plate 150 such as movement of the flange parts 152.

Also, when force is applied to the nip plate 130 from the below (a side of the pressing roller 140), the stay 160 receives the force and supports the nip plate 130. At this time, since the front wall 162 and the rear wall 163 of the stay 160 extend perpendicularly to the base part 131 forming the nip region N of the nip plate 130, it is possible to securely receives the force, which is applied perpendicularly to the base part 131 of the nip plate 130, by the stay 160. Additionally, in this illustrative embodiment, as described later, the nip plate 130 is urged toward the pressing roller 140 by a spring 210, and the force means a reactive force to the force with which the nip plate 130 urges the pressing roller 140.

As shown in FIGS. 7 and 8, the front wall 162 of the stay 160 is provided with the first engaging parts 165A that are an example of the engaging part to which the first hooks 173 of the reflection plate 150 are engaged.

The first engaging parts 165A are provided at a plurality of positions of the flange 164 of the front wall 162 in the axial direction, more specifically, at positions corresponding to the first hooks 173 of the reflection plate 150 in the axial direction. The first engaging parts 165A are provided by forming notched portions 165 at the flange 164.

Also, as shown in FIGS. 4 and 7, the rear wall 163 of the stay 160 is provided with the second engaging parts 167, which are an example of the engaging part to which the second and third hooks 174, 175 of the reflection plate 150 are engaged.

The second engaging parts 167 are provided at positions of the rear wall 163 corresponding to the second and third hooks 174, 175 of the reflection plate 150. The second engaging parts 167 are provided by forming notched portions 165 on a rear surface of the rear wall 163 and a lower end of the rear wall 163.

When the reflection plate 150 is mounted to the stay 160 as described above from the below, leading end portions of the first hooks 173, which are bent upward, pass through the notched portions 165 of the stay 160 and the first hooks are opposed to the first engaging parts 165A in the front-rear direction. Also, base ends of the second and third hooks 174, 175 pass through the notched portions 165 of the stay 160 and leading ends thereof are opposed to the second engaging parts 167 in the front-rear direction.

The reflection plate 150 is mounted to the stay 160, as described above. Thus, when the reflection plate 150 is bent to inwardly move the lower ends of the pair of side walls 151A, 151B, the first to third hooks 173, 174, 175 are respectively engaged to the first engaging parts 165A and the second engaging parts 167. Therefore, the lower ends (end portions of a side of the nip plate 130) of the pair of side walls 151A, 151B are restrained from moving inwardly in the front-rear direction. Thereby, it is possible to suppress the inner surface of the reflection plate 150 from being deformed toward a direction (for example, upper direction) other than the nip plate 130 due to the thermal expansion and the like.

As shown in FIG. 8, the side guides 200 are members that support the halogen lamp 120 and the stay 160, and are provided at left and right axial ends of the stay 160. The side guides 200 are downward urged by the spring 210. Thereby, the stay 160 is urged toward the pressing roller 140, i.e., toward the below.

At this time, since the front wall 162 and the rear wall 163 extend perpendicularly to the nip plate 130, the stay 160 securely presses the nip plate 130 toward the pressing roller 140 by the urging force applied from the spring 210.

Although the second illustrative embodiment of this disclosure has been described, it should be understood that this disclosure is not limited to the illustrative embodiment. The specific configuration can be appropriately changed without departing from the scope of this disclosure.

Figure 11:
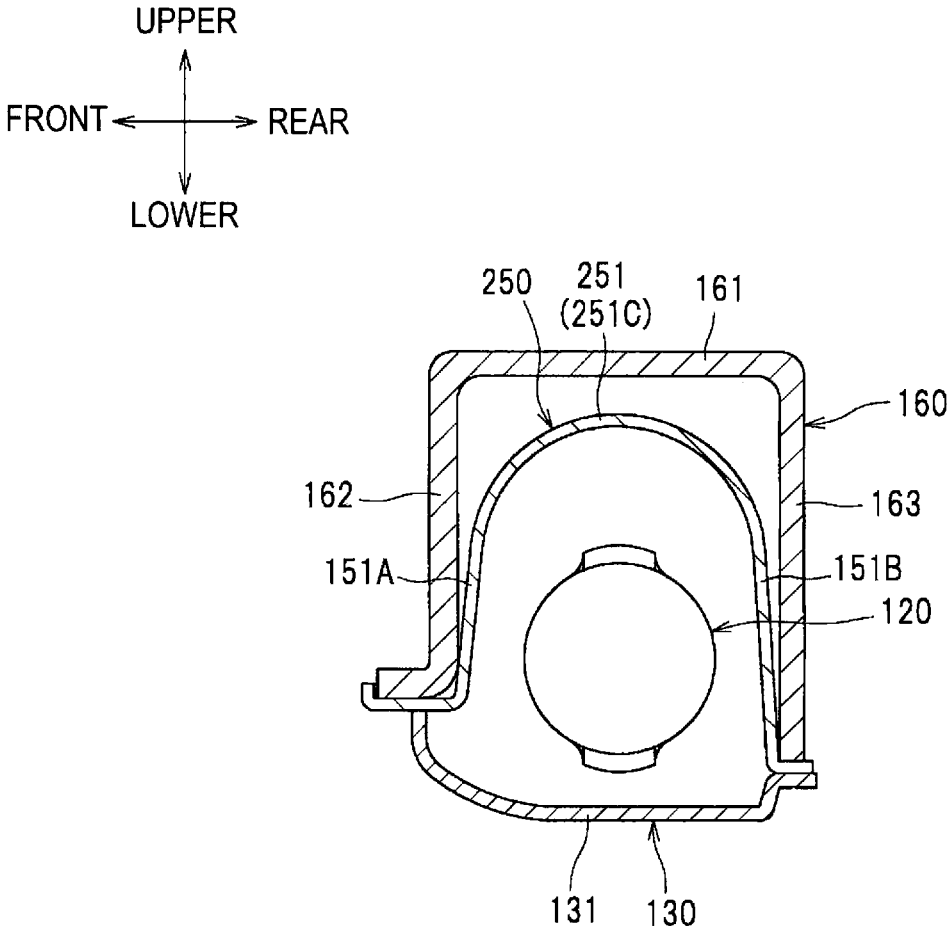
FIG. 11 is a schematic view illustrating a halogen lamp, a nip plate, a reflection plate and a stay in a fuser unit according to a modified embodiment.

In the above second illustrative embodiment, the upper wall 151C of the reflection plate 150 connecting the pair of side walls 151A, 151B is formed to be substantially parallel with the base part 131 of the nip plate 130. However, this disclosure is not limited thereto. For example, as shown in FIG. 11, an upper wall 251C of a reflection plate 250 connecting the pair of side walls 151A, 151B may have an arc-circular shape in which an inner surface thereof faces the base part 131 of the nip plate 130.

In the above second illustrative embodiment, both the side walls 151A, 151B of the reflection plate 150 are inclined so that the inner surfaces thereof face the nip plate 130. However, this disclosure is not limited thereto. For example, one of the pair of side walls of the reflection plate may be inclined so that an inner surface thereof faces the nip plate 130 and the other may extend perpendicularly to the nip plate 130.

In the above second illustrative embodiment, the flange parts 152 of the reflection plate 150 are positioned between the stay 10 and the nip plate 130 and are thus supported to the stay 160. However, this disclosure is not limited thereto. For example, a surface of the reflection plate 150, which faces the stay 160, is provided with a protrusion protruding toward the stay 160 and a surface of the stay 160, which faces the reflection plate 150, is provided with a hole into which the protrusion can be engaged. By this configuration, the protrusion is fitted into the hole to support the reflection plate 150 to the stay 160 without positioning the flange parts 152 of the reflection plate 150 between the stay 160 and the nip plate 130.

In the above second illustrative embodiment, the reflection plate 150 is formed of the aluminum plate. However, this disclosure is not limited thereto. For example, the reflection plate may be a plate-shaped member having an inner surface facing the halogen lamp 120, for which vapor deposition or plating of gold, silver and the like has been performed.

In the above second illustrative embodiment, the stay 160 is urged toward the pressing roller 140. However, this disclosure is not limited thereto. For example, the pressing roller 140 may be urged toward the stay 160.

In the above second illustrative embodiment, the halogen lamp 120 has been exemplified as the heat generation member. However, this disclosure is not limited thereto. For example, a carbon heater may be also used.

In the above second illustrative embodiment, the plate-shaped nip plate 130 has been exemplified as the nip member. However, this disclosure is not limited thereto. For example, a thick member other than the plate shape may be also adopted.

In the above second illustrative embodiment, the pressing roller 140 has been exemplified as the backup member. However, this disclosure is not limited thereto. For example, a belt-type pressing member may be also used.

In the above second illustrative embodiment, the sheet S such as normal sheet and postcard has been exemplified as the recording sheet. However, this disclosure is not limited thereto. For example, an OHP sheet and the like may be also used.

According to illustrative embodiments, it is possible to improve the efficiency of the reflection plate reflecting the radiation heat. Additionally, although the first illustrative embodiment and the first illustrative embodiment are individually described, the first illustrative embodiment and the first illustrative embodiment may be combined.

What is claimed is:

1. A fuser unit for heat-fixing a developer image transferred on a recording sheet while moving the recording sheet in a predetermined direction, the fuser unit comprising:

a cylindrical member having flexibility;

a heat generation member arranged at an inside of the cylindrical member and configured to generate radiation heat;

a nip member that slidingly contacts an inner periphery of the cylindrical member;

a reflection plate that contacts the nip member, is configured to cover the heat generation member and to reflect the radiation heat toward the nip member; and a backup member that forms a nip region by nipping the cylindrical member between the nip member and the backup member, wherein the nip member and the reflection plate intermittently contact each other in an axial direction of the cylindrical member within an image forming width, wherein a plurality of cutout portions are formed at a contacting part of the reflection plate in the axial direction, the contacting part configured to contact the nip member so that the nip member and the reflection plate intermittently contact each other, and wherein a sum of axial lengths of the cutout portions is more than half of an entire axial length of the reflection plate.

2. A fuser unit for heat-fixing a developer image transferred on a recording sheet while moving the recording sheet in a predetermined direction, the fuser unit comprising:

a cylindrical member having flexibility;

a heat generation member arranged at an inside of the cylindrical member and configured to generate radiation heat;

a nip member that slidingly contacts an inner periphery of the cylindrical member;

a reflection plate that contacts the nip member, is configured to cover the heat generation member and to reflect the radiation heat toward the nip member; and a backup member that forms a nip region by nipping the cylindrical member between the nip member and the backup member, wherein the nip member and the reflection plate intermittently contact each other in an axial direction of the cylindrical member within an image forming width, wherein a plurality of cutout portions are formed at a contacting part of the reflection plate in the axial direction, the contacting part configured to contact the nip member so that the nip member and the reflection plate intermittently contact each other, and wherein an outermost cutout portion of the plurality of cutout portions, which is provided at an outermost side in the axial direction, has an axial length that is larger than that of another cutout portion arranged at a substantially central portion in the axial direction.

3. The fuser unit according to claim 1, wherein the reflection plate is a plate-shaped member having a substantially U shape that is opened toward the nip member, as viewed from the axial direction.

4. The fuser unit according to claim 3, wherein the reflection plate has a flange part at an end portion facing the nip member, the flange part extending toward an outside and contacting the nip member, and wherein the cutout portions are formed at the flange part.

5. The fuser unit according to claim 4, further comprising:

a stay that supports a side of the nip member opposite to the backup member, wherein the stay sandwiches the flange part of the reflection plate between the stay and the nip member.

6. The fuser unit according to claim 5, wherein the stay has a substantially U shape that is opened toward the nip member, as viewed from the axial direction.

7. The fuser unit according to claim 5, wherein the stay is made of metal.

8. The fuser unit according to claim 1, wherein the reflection plate is made of metal.

9. The fuser unit according to claim 1, wherein the nip member is made of metal.

10. A fuser unit for heat-fixing a developer image transferred on a recording sheet while moving the recording sheet in a predetermined direction, the fuser unit comprising:

a cylindrical member having flexibility;

a heat generation member arranged at an inside of the cylindrical member and configured to generate radiation heat;

a nip member that slidingly contacts an inner periphery of the cylindrical member;

a reflection plate having a substantially U shape that is opened toward the nip member so as to cover the heat generation member, as viewed from an axial direction of the cylindrical member, the reflection plate comprising a first side wall, a second side wall and an upper wall connecting the first and second side walls, wherein the first and second side walls are inclined;

a backup member that forms a nip region by nipping the cylindrical member between the nip member and the backup member, and a stay having a substantial U shape that is opened at a side facing the nip member so as to cover the reflection plate, as viewed from the axial direction, the stay supporting the reflection plate from an opposite side to the backup member, wherein at least one of a pair of wall parts arranged at both sides of the reflection plate in the predetermined direction is inclined so that an inner surface thereof faces the nip member.

11. The fuser unit according to claim 10, wherein the wall part of the reflection plate has an engaged part, that is to be engaged, and wherein the stay has an engaging part configured to be engaged with the engaged part thereby restraining an end portion of the wall part of the reflection plate, which is positioned at a side facing the nip member, from being inwardly moved.

12. The fuser unit according to claim 10, wherein an end portion of the wall part of the reflection plate, which is positioned at a side facing the nip member, is provided with a flange part extending outwardly, and wherein the stay supports the flange part.

13. The fuser unit according to claim 12, wherein the stay sandwiches the flange part between the nip member and the stay.

14. The fuser unit according to claim 10, wherein a pair of side walls of the stay extends perpendicularly to the nip member, one side wall of the pair of side walls being positioned at a first side in the predetermined direction and another side wall of the pair of side walls being positions at a second side in the predetermined direction.

15. The fuser unit according to claim 10, further comprising:

an urging unit that urges the stay toward the backup member.

16. The fuser unit according to claim 10, wherein the stay is formed of a plate having higher rigidity than that of the reflection plate.

17. The fuser unit according to claim 10, wherein the reflection plate is made of aluminum.

* * * * *